United States Patent [19]

Rivera et al.

[11] Patent Number: 4,617,556

[45] Date of Patent: Oct. 14, 1986

[54] PHOTOSENSITIVE SOUND GENERATOR

[76] Inventors: Luis A. Rivera; Patricia A. Rivera, both of 1278 Cambridge Ave., Plainfield, N.J. 07061

[21] Appl. No.: 629,452

[22] Filed: Jul. 10, 1984

[51] Int. Cl.[4] ..... G08B 13/08; G08B 13/18

[52] U.S. Cl. ..... 340/546; 340/693

[58] Field of Search ..... 340/546, 545, 585, 693; 361/331

[56] References Cited

U.S. PATENT DOCUMENTS

| | | | |
|---|---|---|---|
| 2,992,120 | 7/1961 | Elsken | 340/585 |
| 3,909,819 | 9/1975 | Radford | 340/545 |
| 3,930,249 | 12/1975 | Steck et al. | 340/571 |
| 4,117,461 | 9/1978 | Kiebala | 340/545 |
| 4,155,077 | 5/1979 | Rohan et al. | 340/546 |
| 4,183,019 | 1/1980 | Lekhtman | 340/539 |
| 4,242,670 | 12/1980 | Smith | 340/568 |
| 4,255,745 | 3/1981 | Rohan et al. | 340/546 |
| 4,272,765 | 6/1981 | White | 340/693 |

*Primary Examiner*—Glen R. Swann, III

*Attorney, Agent, or Firm*—John S. Roberts, Jr.

[57] ABSTRACT

A simplified and efficient sound generating device consisting of a self-contained audible signaling device and a means of affording said device protection against moisture and cold temperatures, comprised of a photoelectric cell, a source of energy, a sound transducer means, and appropriate container that permits the entry of light therein. When positioned in an appropriate darkened enclosure, the device permits an immediate audible signal upon the opening of said enclosure and the introduction of light therein. Said device is particularly suited for use as an aid to behavior modification programs that are associated with the need to eliminate the habitual and compulsive over-consumption of food from the diet.

7 Claims, 3 Drawing Figures

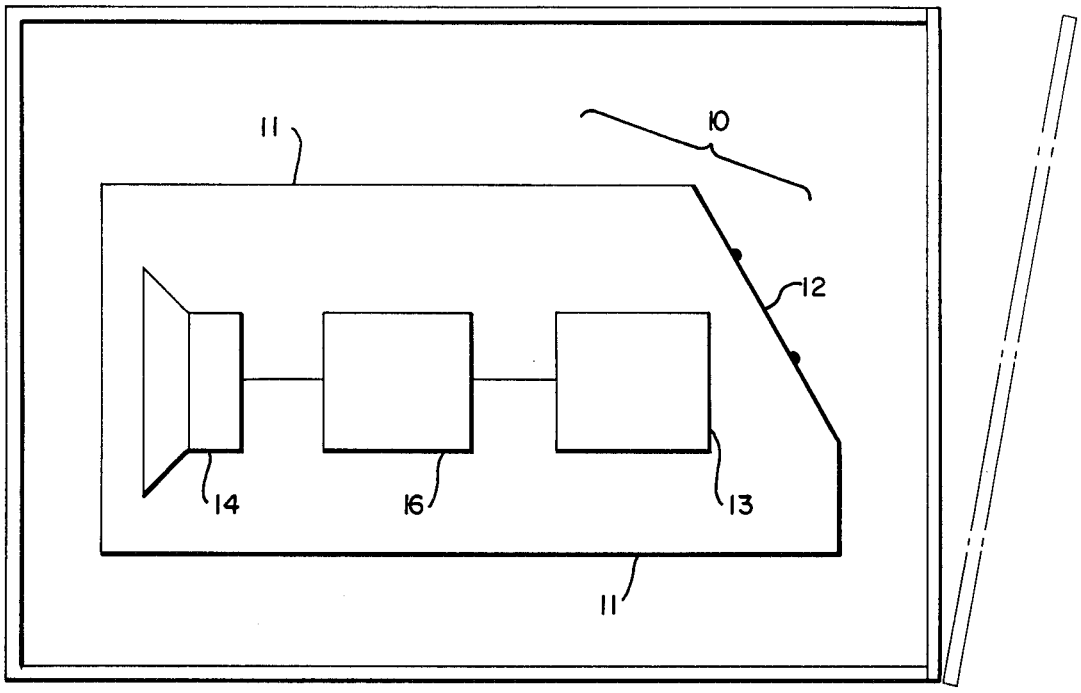
FIG. 1
FIG. 2
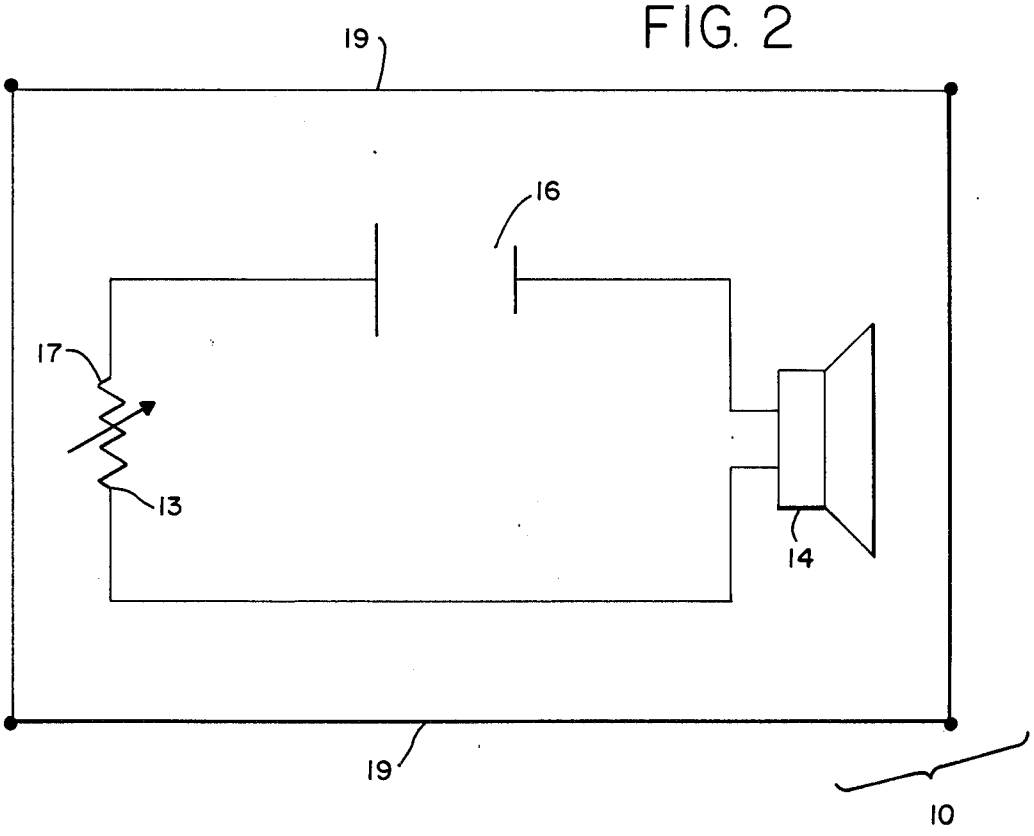

PHOTOSENSITIVE SOUND GENERATOR

BACKGROUND OF THE INVENTION

In a broad sense, the application of various photosensitive means as a component in a signaling device is not new in the art. The development of such devices has primarily been directed toward a variety of alarm systems designed to alert the user to an intrusion into a protected area. U.S. Pat. No. 3,909,819, to Radford, for example, teaches a photosensitive means of signaling the delivery of mail triggered by the opening of a mailbox. U.S. Pat. No. 4,155,077 and 4,255,745, to Rohan, et al., teach a relatively elaborate photosensitive means of producing an audible signal, after a predetermined delay, to warn against such dangers as a child's entry into a medicine cabinet. Devices designed to protect against criminal intrusions vis a vis such items as file cabinets, money clips, and wallets etc. have also been taught (See eg. U.S. Pat. Nos. 4,242,670, to Smith, 4,183,019, to Lekhtman, and 3,930,249, to Steck).

The photosensitive sound generator of present invention is distinguished from the prior art and particularly suited to an application as a behavior modification device and diet aid by its adaptability, simplicity of operation, economy, and innovative application of fundamental concepts which have not heretofor been subject to such concerted and simplified application.

SUMMARY OF THE INVENTION

It is well known in the behavioral sciences that many overweight individuals in need of special diets to limit their caloric intake are often unaware of their frequency of unnecessary food consumption. In order to constructively affect such behavior, it is desirable to bring this frequency to the individual's attention and further to enable the individual to make a negative association with such behavior. Awareness of one's habits is a desirable first step in dealing with such unconscious, self-destructive behavior, and ultimate avoidance is a desired result.

In order to meet this need in an economical and efficient manner, the photosensitive sound generator of the present invention presents a portable, self-contained, and simplified audible alerting device, particularly suited for this use.

In essence, the photosensitive sound generator utilizes a combination of a photoelectric cell, a source of energy, and a sound transducer means, which can be housed within a covering of silicon or other suitable material which would serve to protect the device from moisture or cold temperatures associated with the placement of the device in a cold storage box or other food container. The generator could be of any suitable shape and would contain a lens opening or other suitable aperture that would permit the entry of light upon the opening of the cold storage box or the like. The light would then immediately activate the sound transducer causing a loud audible signal. Such a signal would serve to alert the user as to his or her activity and would further cause avoidance of opening or haste in closing the container.

The present invention provides a photosensitive sound generator that is particularly suitable for initiating a conscious awareness that a refrigerator, food storage cabinet, etc., has been opened. It further provides a photosensitive sound generator that produces a reasonably unpleasant sound so as to cause avoidance of opening or haste in closing the area. In addition, the photosensitive generator will respond immediately.

The present invention provides a device of the foregoing character which is portable, self-contained, simple to use, of relatively simple construction, and is reliable and long lasting in use.

DESCRIPTION OF THE DRAWINGS

FIG. 1 is a simplified block diagram of the photosensitive sound generator.

FIG. 2 is a schematic circuit diagram of the embodiment of the photosensitive sound generator of FIG. 1.

PREFERRED EMBODYMENT OF THE INVENTION

Figure 3:
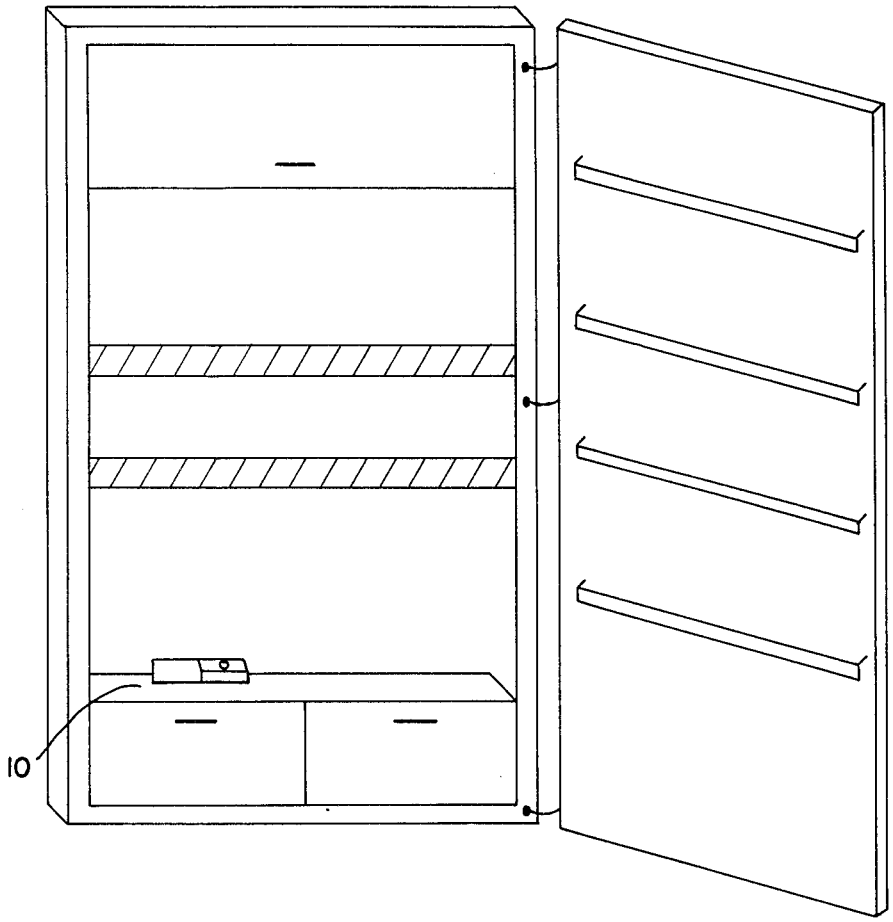
FIG. 3 is a perspective view showing placement of the photosensitive sound generator in a cold storage container.

The Photosensitive Sound Generator of present invention is seen in FIG. 1 and is designated generally by the numeral 10. Said device includes a small case 11, which may be constructed of plastic or metal or other suitable material, and is suitably shaped for enclosing all of the circuit elements as well as a source of energy for such circuitry. The case 11, contains an aperture 12, which may simply be an opening in the case but may also be a lens or other suitable means that will permit light to enter said case. A photoelectric cell 13, is positioned within the case 11 with respect to the aperture 12, in a manner permitting it to receive light entering the aperture. Said cell 13, provides a signal in response to the detected light to a sound transducer 14, which can be a piezoelectric device, in said case 11, which will provide an audible alerting signal to a person outside the enclosure. Other types of sound transducers such as voice synthesizers, bells, buzzers, etc. may also be used. The entire system may be powered by a standard 9 volt battery or other suitable portable power means 16. The device 10, may be placed within a cold storage container as can be seen in FIG. 3.

The overall circuitry of the preferred embodiment of the device is shown generally in FIG. 2, wherein the battery 16, supplies a suitable potential to the citcuit, including the photoresistor 17. Thus, a current flows to the photoelectric cell 13, which may be, but is not limited to the photoresistor type, in that solar cells, photodiodes, phototransistors, etc. may be substituted. As will be understood, the resistance of the photoelectric cell changes in response to light detected by the cell, thereby producing a change in voltage across the cell.

The preferred circuit can further be simplified by using only a solar cell and a sound transducer, thus eliminating a battery 16. A switch or timer may be added as desired, to permit down periods, however, such is not necessary to the overall operation of the device. The circuit can also be altered to provide varied frequencies. The circuitry may also be enclosed in silicon 19, or other suitable material to prevent moisture from activating the sound transducer.

It is pointed out that when circuit devices of the type noted herein are employed for the present device, it is practical for the case 11 to be of very small size. Accordingly, the device is quite versatile and may readily be placed in a food storage cabinet or other small enclosure.

What is new and desired to be protected by Letters Patent is:

1. A self-contained photosensitive sound generator for use as an aid to behavior modification programs meeting the need to eliminate habitual and compulsive over-consumption of food stored in a darkened enclosure, such as a refrigerator or food storage container, comprising:

(a) a housing adapted to contain a photosensitive cell, a sound transducer and an energy source for said cell and transducer;

(b) a sound transducer in said housing;

(c) a photoelectric cell in electrical communication to said energy source responsive to light when said enclosure is opened for the purpose of taking food, said photoelectric cell immediately energizing said sound transducer when activated by light to thereby cause a low audible signal alerting the person opening the enclosure to light that the opening behavior is to be stopped;

(d) an energy source in said housing;

(e) moisture protecting means surrounding said housing to protect said cell, said sound transducer and said energy source from moisture and cold temperature; and an optical aperture in said housing located directly in front of said photosensitive cell which permits and directs the light entering the enclosure against said cell to energize the same.

2. The generator as claimed in claim 1 wherein said aperture is a lens.

3. The generator as claimed in claim 1 wherein said aperture is an opening.

4. The generator as claimed in claim 1 wherein said sound transducer is a bell.

5. The generator as claimed in claim 1 wherein said sound transducer is a buzzer.

6. The generator as claimed in claim 1 wherein said energy source is a battery.

7. The generator as claimed in claim 1 wherein said energy source is a solar battery.

* * * * *